US007275530B2

(12) United States Patent
Deak

(10) Patent No.: US 7,275,530 B2
(45) Date of Patent: Oct. 2, 2007

(54) PAINTBALL GUN

(76) Inventor: Bernard A. Deak, 18920 White Oak Dr., Chagrin Falls, OH (US) 44023

( * ) Notice: Subject to any disclaimer, the term of this patent is extended or adjusted under 35 U.S.C. 154(b) by 0 days.

(21) Appl. No.: 11/198,568

(22) Filed: Aug. 5, 2005

(65) Prior Publication Data

US 2007/0028908 A1 Feb. 8, 2007

(51) Int. Cl.
*F41B 11/02* (2006.01)

(52) U.S. Cl. ..... 124/73; 124/51.1

(58) Field of Classification Search ..... 124/51.1, 124/52, 53.5, 73, 74, 75
See application file for complete search history.

(56) References Cited

U.S. PATENT DOCUMENTS 5,282,454 A * 2/1994 Bell et al. ..... 124/49
5,505,188 A 4/1996 Williams
5,572,982 A * 11/1996 Williams ..... 124/74
5,673,679 A * 10/1997 Walters ..... 124/53.5
5,816,232 A 10/1998 Bell
5,904,133 A * 5/1999 Alexander et al. ..... 124/73
5,954,042 A * 9/1999 Harvey ..... 124/51.1
6,364,162 B1 * 4/2002 Johnson et al. ..... 222/61
6,409,150 B2 * 6/2002 Sullivan et al. ..... 251/360
6,418,919 B1 * 7/2002 Perrone ..... 124/49
6,609,511 B2 8/2003 Kotsiopoulos et al.
6,626,165 B1 * 9/2003 Bhogal ..... 124/77
6,675,791 B1 * 1/2004 Alexander et al. ..... 124/71
6,739,323 B2 * 5/2004 Tippmann, Jr. ..... 124/51.1
6,766,795 B1 * 7/2004 Sullivan ..... 124/56
6,978,776 B2 * 12/2005 Hamilton ..... 124/51.1
2002/0096163 A1 * 7/2002 Perrone ..... 124/49
2006/0162712 A1 * 7/2006 Yeh ..... 124/73
2006/0225795 A1 * 10/2006 Baker ..... 137/614.19

* cited by examiner

*Primary Examiner*—Troy Chambers
*Assistant Examiner*—Stewart T Knox
(74) *Attorney, Agent, or Firm*—Pearne & Gordon LLP

(57) ABSTRACT

A removable air bleed assembly for use with between a paintball gun and an auxiliary system includes a pin having an elongated pin channel extending through a majority of the pin to bleed pressurized air from the paintball gun. An air conduit is coupled between and in fluid communication with the removable pin and an auxiliary assembly to facilitate passage of the pressurized air from the paintball gun to the auxiliary assembly. The removable pin can be manually removed from the paintball gun without the need for any tools. The auxiliary system can be at least one of an agitator system and an uploader system, as an example.

29 Claims, 8 Drawing Sheets

PAINTBALL GUN

BACKGROUND OF THE INVENTION

1) Field of Invention

The present invention relates generally to a pneumatic gun for shooting balls, such as balls filled with liquid paint for sporting events.

2) Description of the Prior Art

Popularity and developments in the paintball industry have led to the demand for increased performance from paintball guns. Paintball gun users usually partake in paintball war games. A paintball war game is generally played between two teams of players that try to capture the opposing team's flag. Each flag is located at the team's home base. Such a game is played on a large field with opposing home bases at each end. The players are each armed with a paintball gun that shoots paintballs. Paintballs are gelatin-covered spherical capsules filled with paint.

During the game, the players of each team advance toward the opposing team's base in an attempt to steal the opposing team's flag. The players must do so without first being eliminated from the game by being hit by a paintball shot by an opponent's gun. When a player is hit by a paintball the gelatin capsule ruptures and the paint is splashed onto the player. As a result the player is "marked" and is out of the game.

These war games have increased in popularity and sophistication resulting in more elaborate equipment. One such improvement is the use of semi-automatic and automatic paintball guns that allow for rapid firing of paintballs. As a result of the increased firing speed, a need has developed for increased storage capacity of paintballs in the paintball loaders that are mounted to the gun. Also, users demand faster feed rates as the guns continue to develop.

Paintball loaders typically include a housing that sits on an upper portion of a paintball gun and which is designed to hold a large quantity of paintballs. There is an outlet tube at the bottom of the housing through which the paintballs drop by the force of gravity. The paintballs pass into an inlet tube located in the upper portion of the gun.

In use, paintballs fall sequentially through the outlet tube into the inlet of the gun. The inlet tube directs each paintball into the firing chamber of the gun where the paintball is propelled outwardly from the gun by compressed air. Because existing paintball loaders rely on the force of gravity to feed the paintballs to the gun, they function properly to supply paintballs only if the gun and the loader are held in a substantially upright position. If, during a game, a player is forced to hold the gun sideways or upside down, the loader will not function properly.

Furthermore, it is not uncommon that, while feeding paintballs to the gun, the paintballs jam in the gun. In order to correct the problem, the player may shake the gun or strike the loader in order to dislodge the jammed paintball. This obviously places the player at risk during the game since the player is distracted by the need to adjust the equipment.

Conventional paintball loaders, as described in U.S. Pat. No. 5,816,232 to Bell et al., the entirety of which is incorporated by reference herein, utilize an optical sensor mounted within the loaders to detect the absence of a paintball in the infeed tube of a paintball gun. When the sensor detects that there is no paintball in the infeed tube of the paintball gun, a motor is activated which causes a paddle to force a paintball into the paintball gun. Other conventional paintball loaders, as described in U.S. Pat. No. 6,609, 511 to Kotsiopoulos et al., the entirety of which is incorporated by reference herein, utilize agitators having sound sensors to sense a gun firing event. In response to the sound of the gun firing, an electrical signal is sent to activate an agitator that moves a paintball into the feed tube.

While recent feed systems are an improvement over the prior feeders, the current feed systems are complicated and costly to manufacture. Such systems may also lead to jamming.

BRIEF SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with an aspect of the present invention, an air bleed assembly for a paintball gun is provided. The air bleed assembly includes: a pin; an elongated pin channel extending through a majority of the pin; an air conduit having a first end and a second end, the first end being coupled to and in fluid communication with the elongated pin channel; and a connector element coupled to the second end of the air conduit, wherein said pin is manually removable from a paintball gun without the need for any tools.

In accordance with another aspect of the present invention, a paintball gun and air bleed assembly is provided, which includes: a paintball gun body having an aperture therein; and a pin adapted to be removably positioned within the aperture, wherein the pin includes at least one channel in fluid communication with an elongated chamber of the paintball gun when the pin is positioned within the aperture.

In accordance with yet another aspect of the present invention, an agitator and air bleed assembly for a paintball gun is provided. The assembly includes: an agitator head coupled to a piston; a piston housing for slidably housing the piston; an air conduit having a first end coupled to the piston housing such that the air conduit is in fluid communication with an interior portion of the piston housing; and a pin coupled to the second end of the air conduit, the pin having at least one channel in fluid communication with the air conduit.

In accordance with yet another aspect of the present invention, an uploader and air bleed assembly for a paintball gun is provided. The assembly includes: a discharge tube; and a loading mechanism adapted to feed paintballs upwards into the discharge tube; an air conduit having a first end coupled to the loading mechanism such that the air conduit is in fluid communication with the loading mechanism; and a pin coupled to the second end of the air conduit, the pin having at least one channel in fluid communication with the air conduit.

The following description and the annexed drawings set forth in detail certain illustrative aspects of the invention. These aspects are indicative, however, of but a few of the various ways in which the principles of the invention may be employed and the present invention is intended to include all such aspects and their equivalents. Other objects, advantages and novel features of the invention will become apparent from the following detailed description of the invention when considered in conjunction with the drawings.

BRIEF DESCRIPTION OF THE DRAWINGS

The foregoing and other features and advantages of the present invention will become apparent to those skilled in the art to which the present invention relates upon reading the following description with reference to the accompanying drawings, in which.

DESCRIPTION OF EXAMPLE EMBODIMENTS

Figure 1:
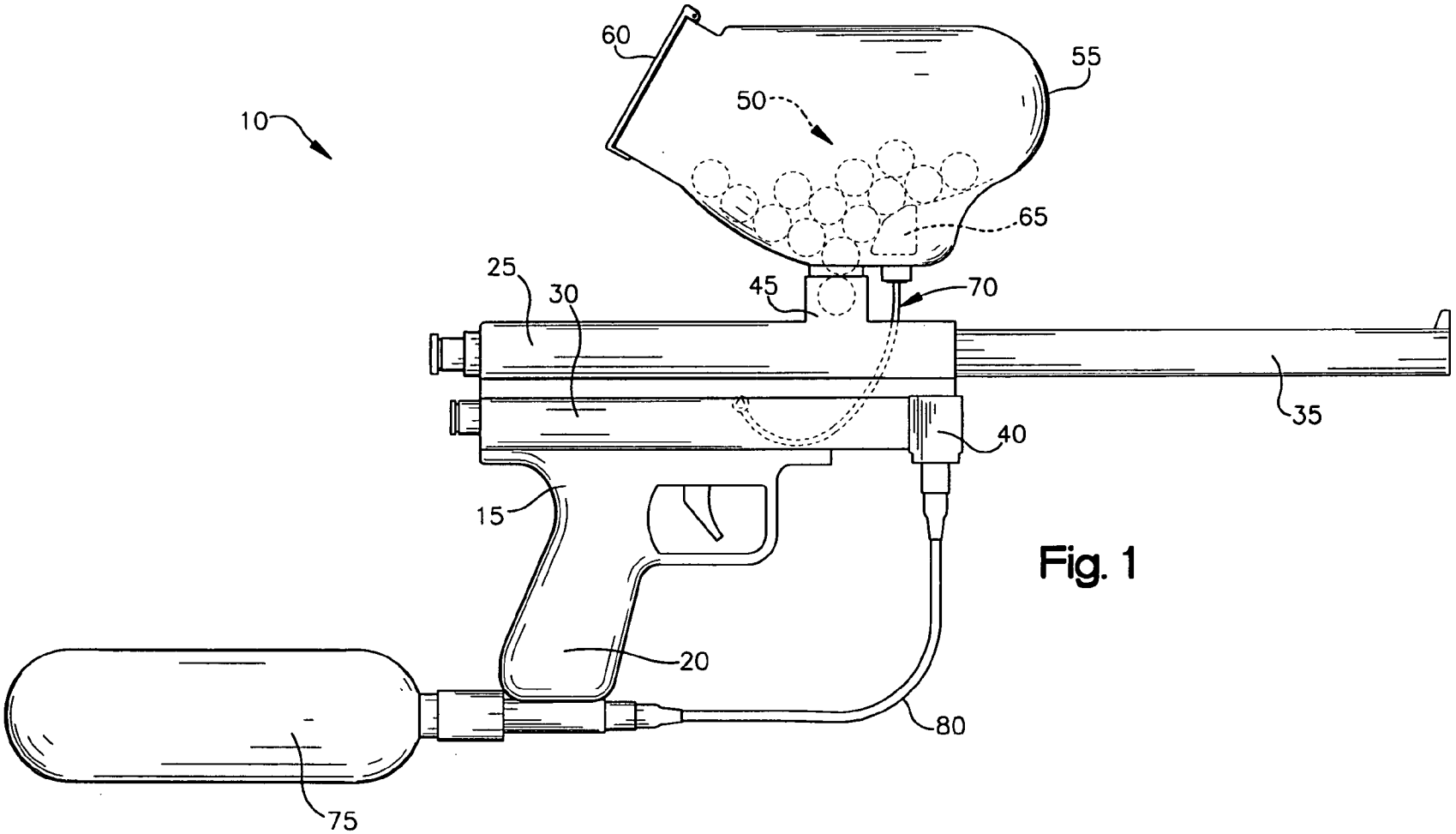
FIG. 1 illustrates a side view of a paintball gun having a removable air bleed system coupled to an agitator system in accordance with an aspect of the present invention.

The present invention relates to a paintball gun. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention can be practiced without these specific details.

Referring initially to FIG. 1, an example of a paintball gun 10 is illustrated in accordance with an aspect of the present invention. The paintball gun 10 comprises a body 15 manufactured from metal, plastic, or any other suitable material or combination of materials. The body 15 includes a handle or handgrip 20 and at least one elongated chamber. First and second elongated chambers 25 and 30 are described and illustrated herein; however, it is to be appreciated that a paintball gun having any number of elongated chambers (e.g., one) can be utilized with the present invention. The body 15 further includes a barrel 35, a gas inlet 40 for receiving pressurized gas, and a ball inlet 45 for receiving a paintball 50. A plurality of paintballs 50 can be housed in a hopper 55, which is coupled to the ball inlet 45 of the paintball gun body 15 such that the paintballs 50 can be fed into a firing chamber of the paintball gun 10. The paintballs 50 are loaded into the hopper 55 via an opening 60 provided therein. An agitator 65 is positioned in the hopper 55 to mitigate 'sticking together' of the paintballs 50. The agitator 65 is actuated via compressed gas, which is bled from one of the elongated chambers 25, 30 via a removable air bleed system 70. The actuator 65 and the removable air bleed system 70 will be described below in further detail. A container of pressurized gas 75 is coupled to the gas inlet 40 of the paintball gun 10 via a flexible conduit 80.

Figure 2:
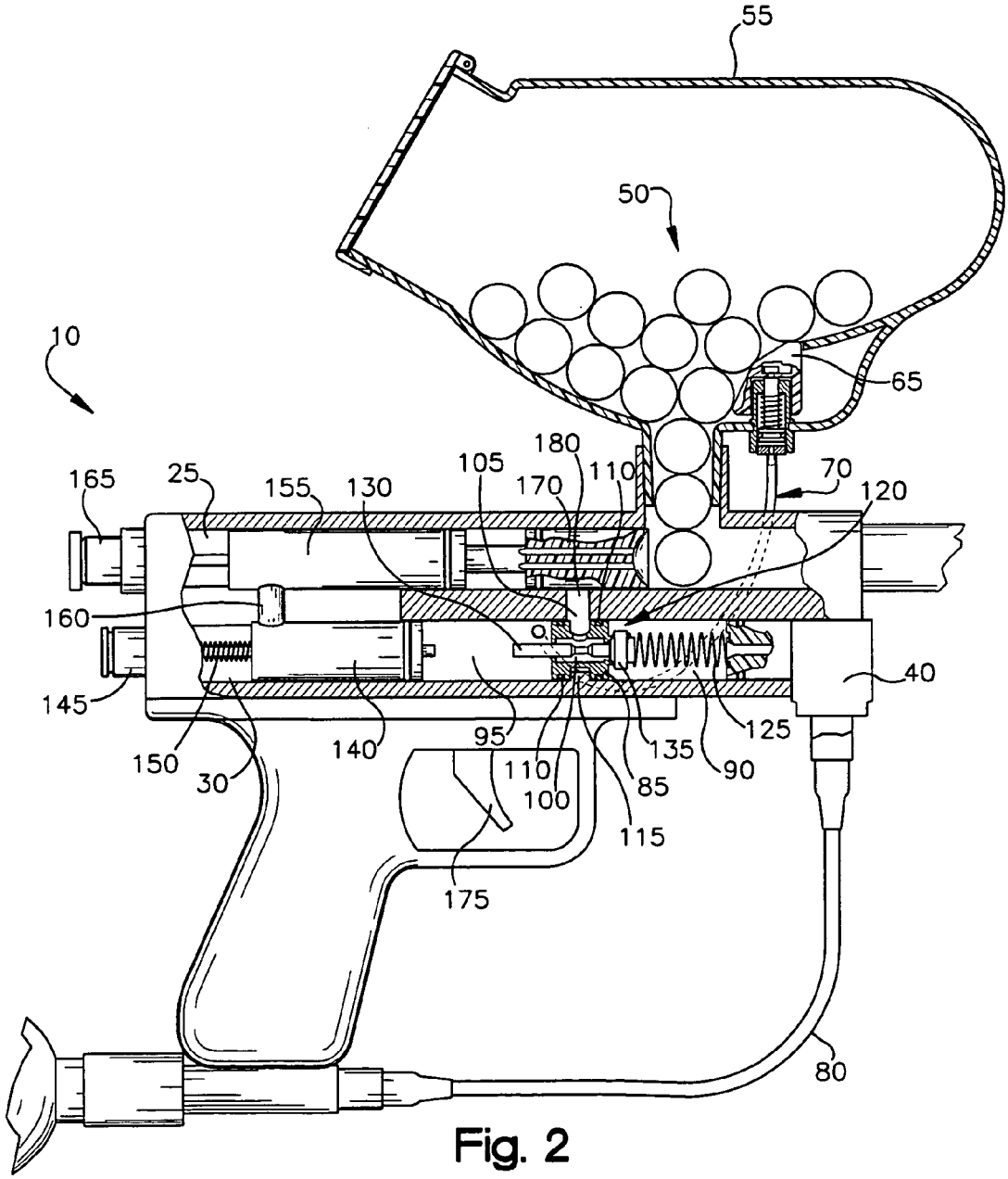
FIG. 2 illustrates a cross sectional side view of the paintball gun of FIG. 1 having a hammer component in a cocked position in accordance with an aspect of the present invention.

Turning now to FIG. 2, a partially cross sectional view of the paintball gun 10 is illustrated in accordance with an aspect of the present invention. The second elongated chamber 30 is adapted to receive a valve body 85. The valve body 85 partitions second elongated chamber 30 into a first section 90 and a second section 95. The valve body 85 has a coaxial bore 100 and a transverse bore 105, which act as fluid ports. The diameters of bores 100 and 105 are selected to achieve a ratio of fluid flow between the bores 100 and 105 to accommodate proper firing and reload functions of the paint ball gun 10, as described below. The valve body 85 is sealed by o-rings 110 and secured in the second elongated chamber 30 via a protrusion 115 extending from an inner surface of the second elongated chamber 30. A poppet 120 is seated in bore 100 and maintained by a spring 125. The poppet 120 includes a valve pin 130 and a valve cup seal 135, which is threaded on valve pin 130.

The second elongated chamber 30 further houses a hammer 140, which is coupled to a bolt 145 via a spring 150. The bolt 145 can be rotated to increase or decrease tension on the spring 150, which in turn adjusts a speed with which the hammer 140 is released and, as a result, controls an amount of compressed air that is released, which ultimately controls the velocity of a paintball 50 when fired. The hammer 140 is also coupled to a cocking shaft 155, which is housed in the first elongated chamber 25, via a pin 160. The cocking shaft 155 is coupled between a cocking knob 165 and a firing bolt 170.

Pulling back on the cocking knob 165 pulls the firing bolt 170 toward a ready (cocked) position. Because the firing bolt 170 is connected by pin 160 to the hammer 140, the hammer 140 is also drawn back until it deflects a sear (not shown), and the sear engages a hammer catch (not shown) on the hammer 140. When the hammer catch is engaged, the hammer 140 is in the ready position. When a trigger 175 is pulled, the trigger 175, which is coupled to the sear, disengages the sear from the hammer catch, thereby releasing the hammer 140 into a firing position and initiating a firing sequence.

Upon release, the hammer 140 moves forward in the second elongated chamber 30 and hits the valve pin 130 of the poppet 120. The poppet 120 is unseated from bore 100 and pressurized air contained in first section 90 of the second elongated chamber 30 is released through bore 100. When the valve body 85 is positioned within the second elongated chamber 30 such that bore 105 is aligned with a passageway 180, which is provided between the first and second elongated chambers 25, 30, some of the pressurized air discharges through the passageway 180 and into the first elongated chamber 25 to fire the paintball 50. The remaining portion of pressurized air flows through the bore 100 into the second section 95 of the second elongated chamber 30. The pressurized air in the second section 95 creates a "blow back" pressure. In other words, the air pressure acts against hammer 140 such that the hammer 140 recoils or "blows back" toward the ready position in which the sear engages the hammer catch. After the hammer 140 is released from abutment with the poppet 120, tension from the poppet spring 125 along with compressed air pressure in the first section 90 reseats the valve seat 135 of the poppet 120 against the valve body 85, thereby closing passageway 80. The paintball gun 10 is now re-cocked and ready for firing. The above-described firing sequence is known as semi-automatic, because the gun automatically re-cocks itself after firing.

As will be understood by one of skill in the art, the balance of compressed gas flowing between bores 100 and 105 will affect the velocity of the paintball 05 and the velocity that hammer 140 is "blown back". One way of apportioning the amount of air that flows through either bore 100 or bore 105 of valve body 85 is established by the respective diameters of bores 100 and 105. Another way of establishing the respective airflow between bores 100 and 105 is by adapting a non-circular cross-section for valve pin 130. For example, valve pin 130 may be provided with a longitudinal cut away or groove, which allows additional airflow through bore 100. These variables may be adjusted by those skilled in the art to achieve an optimum balance for gas efficiency and firing velocity.

Figure 3:
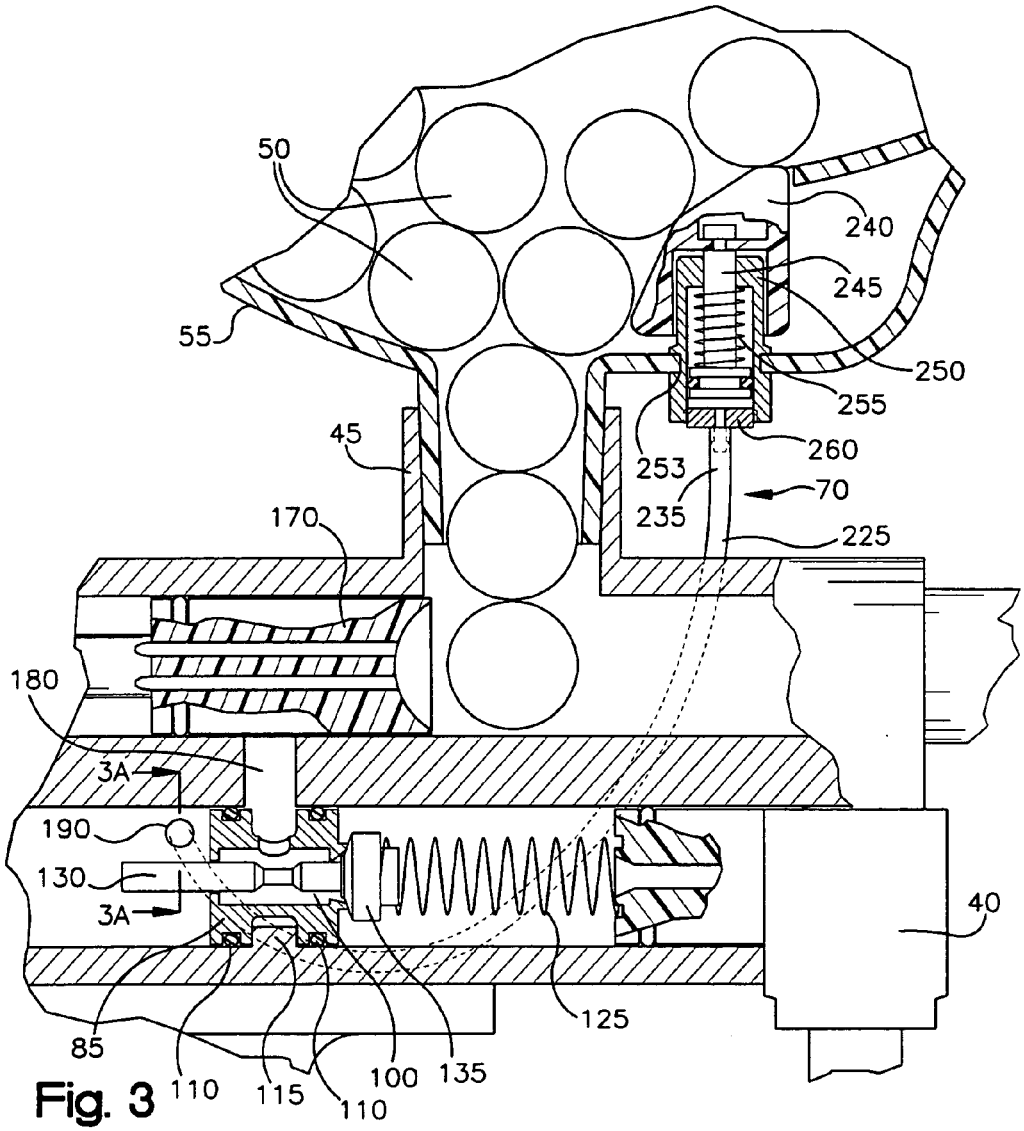
FIG. 3 illustrates a cross sectional side view of the paintball gun of FIG. 1 showing details of the agitator system in accordance with an aspect of the present invention.
Figure 3A:
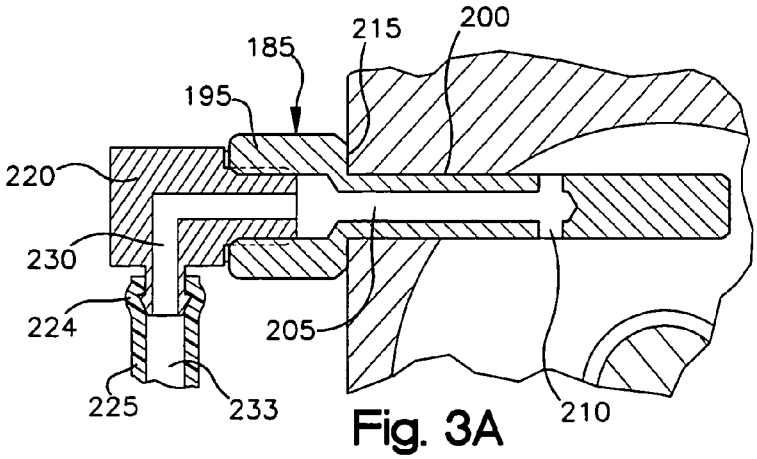
FIG. 3A illustrates a cross sectional view of an air bleed system for a paintball gun in accordance with an aspect of the present invention.

Turning now to FIGS. 3 and 3A, the removable air bleed system 70 for use with the paintball gun 10 is depicted in greater detail in accordance with an aspect of the present invention. The removable air bleed system 70 comprises a removable power take off pin 185, which is adapted to be positioned within an aperture 190 provided in the paintball gun body 15. The aperture 190 can be a pre-existing aperture in a paintball gun. Some conventional paintball guns include a stop pin permanently provided within such an aperture to mitigate the valve body from moving backwards into the elongated chamber. Thus, the conventional stop pin can be detached from the paintball gun and the removable power take off pin 185 can be positioned within the aperture in place of the conventional stop pin. Thus, pre-existing aperture can be utilized and no holes need to be drilled within the body of the gun. The removable power take off pin 185 is adapted such that the power take off pin 185 can bleed pressurized air from the second section 95 of the second elongated chamber 30, or the blow back chamber. Further, the removable power take off pin 185 can be manually removed and replaced within the aperture 190 without the need for any tools.

Thus, when the pin 185 is positioned in the aperture 190, the pin 185 can serve two functions: 1. the pin 185 can hold the valve body 85 in place; and 2. the pin 185 can bleed some of the pressurized air from the blow back chamber 95 to an auxiliary system, such as an agitator system, an uploader system, or any other suitable auxiliary system. The pressurized air is bled from the paintball gun 10 during the blowback process. The valve 85 opens, blows gas up bore 105 into the firing chamber to shoot the paintball 50; and, at the same time, gas enters second section 95 to blow back the hammer 140 into a cocked position.

Turning to FIG. 3A, the removable pin 185 includes a head portion 195 and a body portion 200. An elongated pin channel 205 extends through the head portion 195 and through a majority of the body portion 200. One or more radial pin channels 210 extend through the body portion 200 and are in fluid communication with the elongated pin channel 205. The head portion 195 includes a shoulder 215 that abuts the body 15 of the paintball gun 10 when the pin 185 is positioned within the aperture 190. A connector 220 is provided to couple the removable pin 185 with a first end 224 of a tubing component 225, or any other suitable air conduit. The connector 220 can be an elbow connector and can be coupled between the removable pin 185 and the tubing 225 via any suitable fastener, such as a threaded connection, a snap fit connection, and the like. The connector 220 also includes an air passageway 230 that is in fluid communication between the elongated pin channel 205 and an interior channel 233 in the tubing 225. Alternatively, the tubing 225 can be coupled directly to the removable pin 185 without the use of a separate connector element.

Turning back to FIG. 3, a second end 235 of the tubing 225 is coupled to the agitator assembly 65 provided in the paintball hopper 55. The agitator assembly 65 includes a wedge shaped agitator head 240 coupled to and movable with a piston 245. The piston 245 is vertically slidable within a piston housing 250, which is coupled to the paintball hopper 55. For instance, the piston housing 250 can include a circumferential groove 253, which is adapted to receive a portion of the paintball hopper 55 thereby securing the piston housing 250 to the paintball hopper 55. It is to be appreciated that the piston housing 250 can be secured to the paintball hopper 55 in any other suitable manner. A spring 255 is provided within the piston housing 250 to bias the piston 250 in a non-extended position, as depicted in FIG. 3. A coupling element 260 is provided to join the second end 235 of the tubing 225 with the piston housing 250. The coupling element 260 includes a channel therein to allow pressurized air bled from the paintball gun 10 into the piston housing 250.

Figure 4:
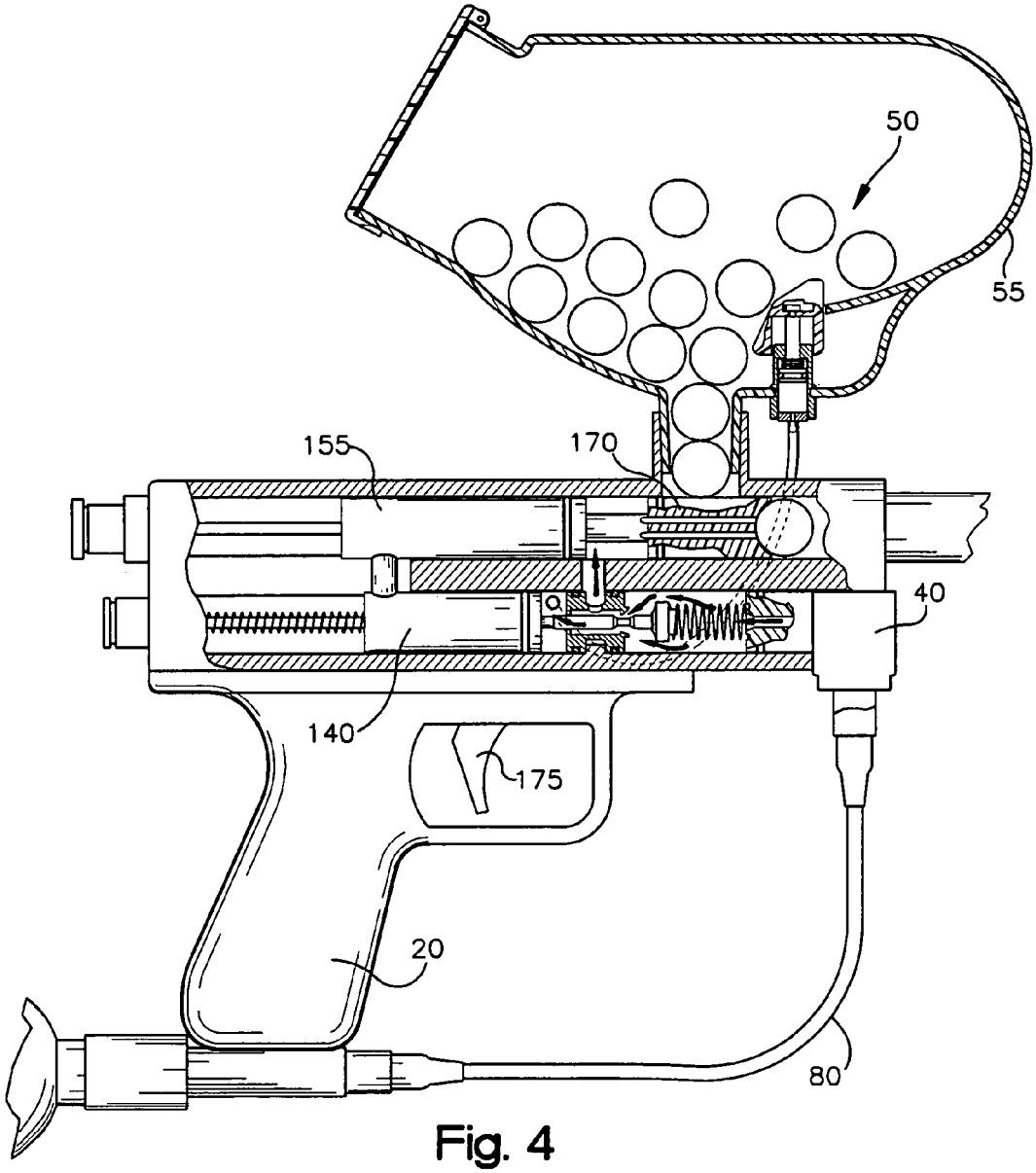
FIG. 4 illustrates a cross sectional side view of the paintball gun of FIG. 1 having the hammer component in a released position in accordance with an aspect of the present invention.
Figure 5:
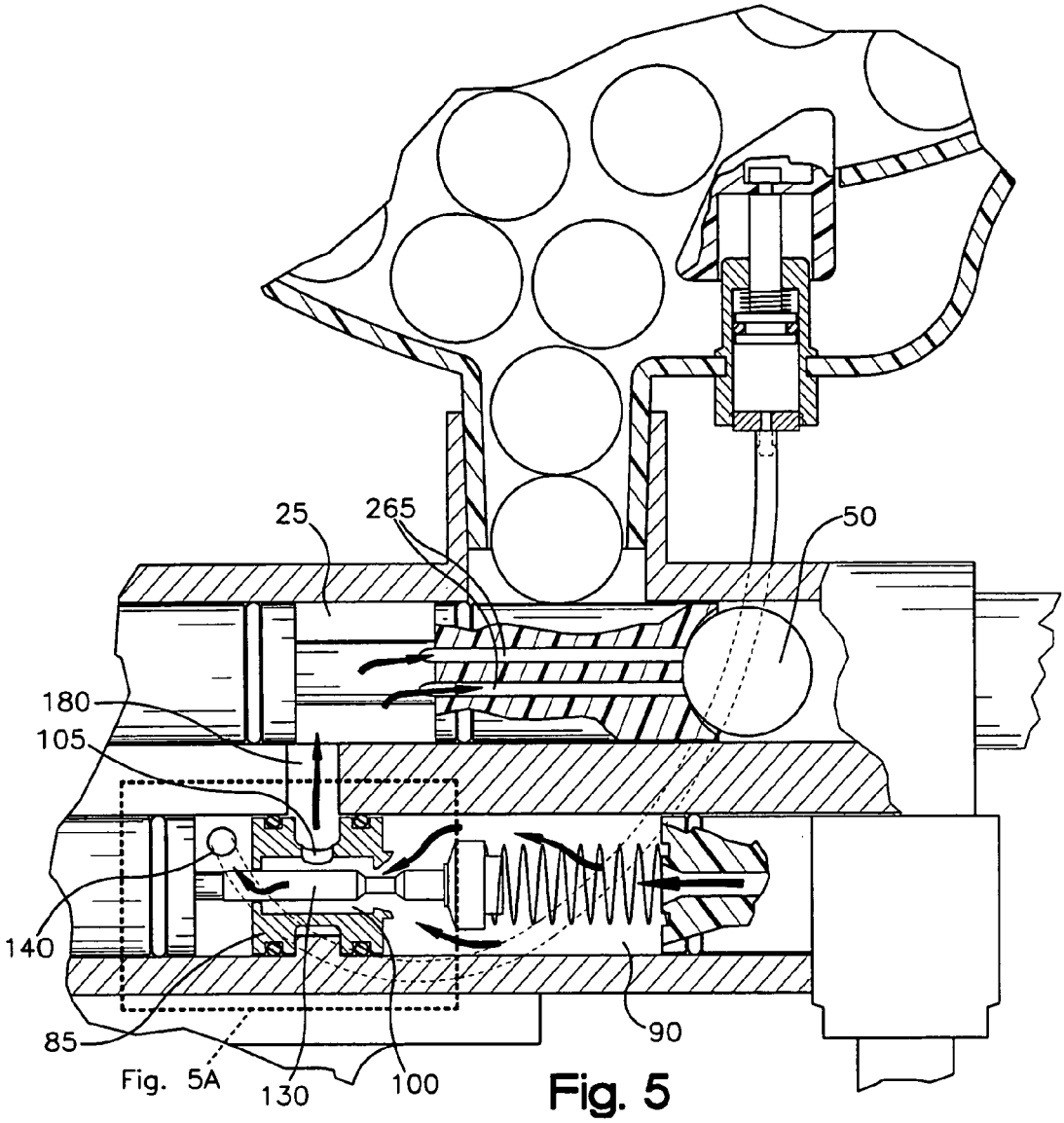
FIG. 5 illustrates a cross sectional side view of FIG. 1 showing pressurized air flow through portions of the paintball gun in accordance with an aspect of the present invention.
Figure 5A:
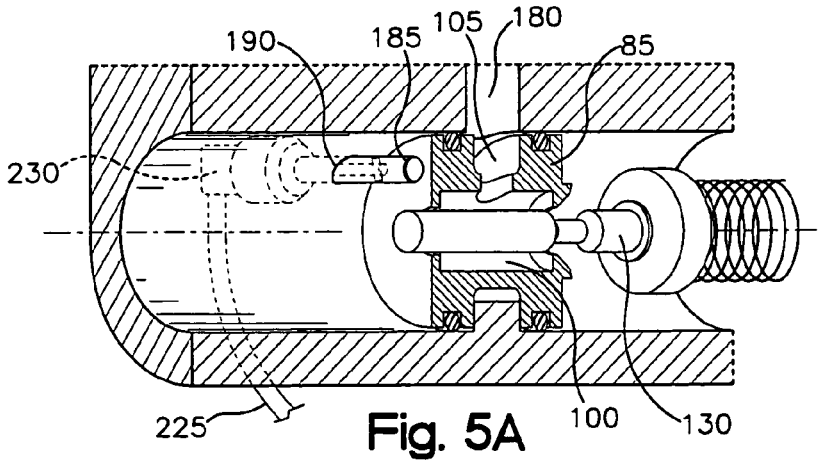
FIG. 5A illustrates a cross sectional view of an air bleed system for a paintball gun in accordance with an aspect of the present invention.

FIGS. 4-5A depict an example of the removable air bleed assembly 70 employed to actuate the agitator assembly 65 in accordance with an aspect of the present invention. During operation of the paintball gun 10, the hammer 140 is initially held in a cocked position by the sear (not shown), which is coupled to the trigger 175. When the trigger 175 is pulled, the sear releases the hammer 140, which moves forward to contact the poppet 130, which is, in turn, unseated from the valve body 85. When valve 85 is opened, pressurized air housed in the first section 90 of the second elongated chamber 30 is released through bores 100 and 105 of the valve body 85. The pressurized air released through vertical bore 105 enters the first elongated chamber 25 through aperture 180 and flows through one or more bolt ports 265 to fire the paintball 50. At substantially the same time, the pressurized air released through horizontal bore 100 enters the second section 95 of the second elongated chamber 30 to blow back the hammer 140 into the cocked position.

A portion of the pressurized air that enters the second section 95 of the second elongated chamber 30 is bled to the agitator assembly 65 via the power take off pin 185, which is removably positioned in the air bleed aperture 190. The pressurized air enters the pin channels 205, 210 and flows through the pin 185, through the connector 220, and through the tubing 225 to the agitator assembly 65. When the pressurized air enters the piston housing 250, the piston 245 is forced upwards against the force of the spring 255 thereby moving the agitator head 240 upwards into the paintball hopper 55 to agitate or stir the paintballs 50 in the hopper to mitigate a jam as the paintballs 50 move toward a discharge from the hopper 55 for supply to the paintball gun 10. The wedge shape of the agitator head 240 facilitates movement of the paintballs 50 towards the discharge opening of the hopper 55. Thus, each time the pressurized air is bled from second chamber 30 of the paintball gun 10, the agitator assembly 65 is actuated. In other words, each time the trigger 175 of the paintball gun 10 is pulled and the power take off pin 185 is positioned in the air bleed aperture 190, the agitator head 240 is moved upwards to agitate the paintballs 50 in the hopper 55. Thus, no batteries, electronics, etc. are required to agitate the paintballs, as is in the conventional art.

Figure 6:
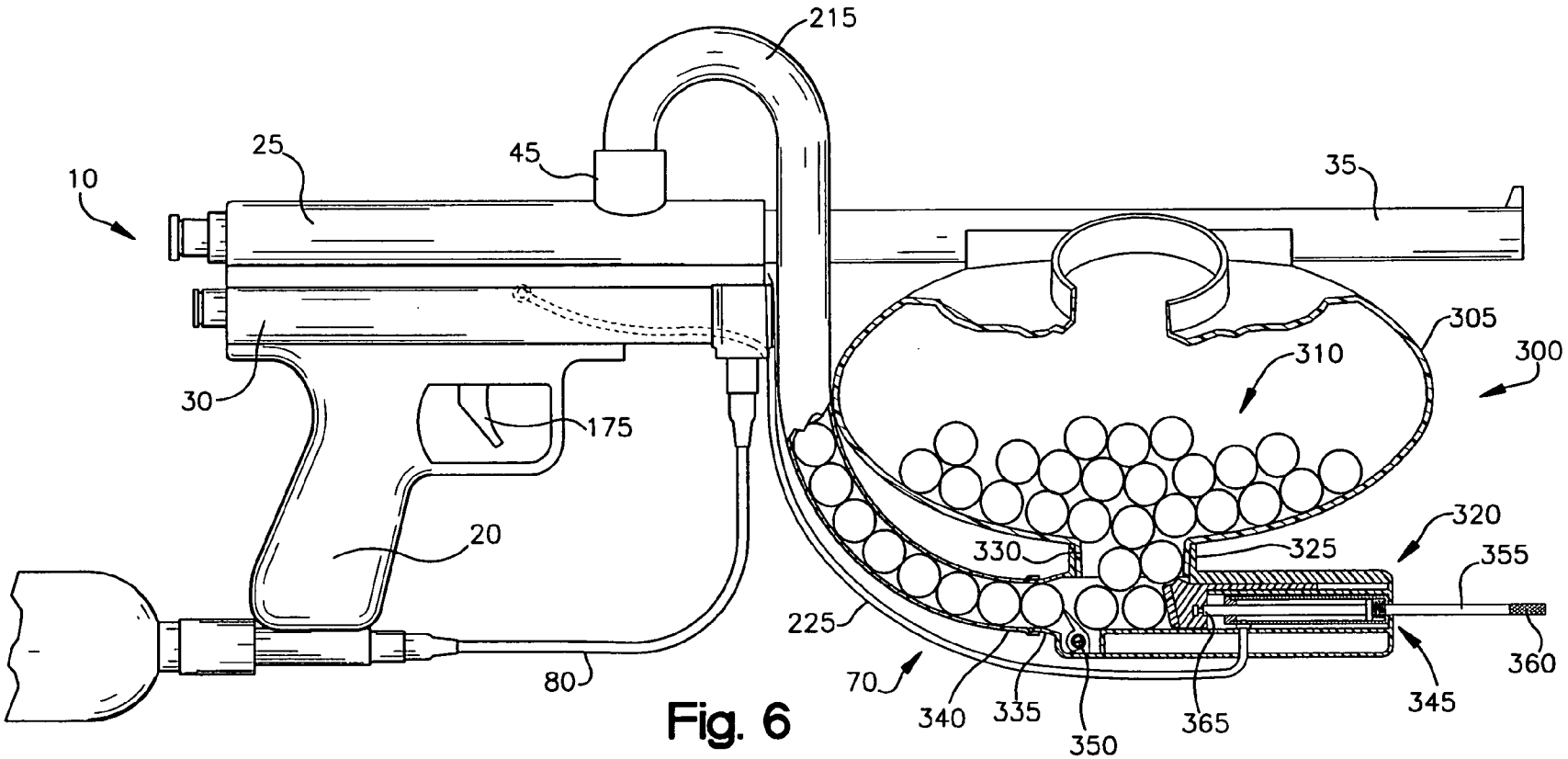
FIG. 6 illustrates a paintball gun coupled to an uploader system in accordance with an aspect of the present invention.

FIGS. 6-10 illustrate an uploader system 300 for a paintball gun 10 in accordance with an aspect of the present invention. As shown in FIG. 6, a paintball hopper 305 is mounted below and/or beside the paintball gun 10. Any suitable type of paintball gun can be employed with the uploader system 300. For instance, the paintball gun can be similar to the paintball gun discussed with respect to FIGS. 1-5 herein. Accordingly, in FIG. 6, component parts alike those shown in FIGS. 1-5 are shown by like reference numerals and, the details thereof are not reinstated for the sake of brevity. The uploader system 300 utilizes excess air pressure from the paintball gun 10 to push a plurality of paintballs 310 up and out of a discharge tube 315 coupled to the paintball hopper 305. The discharge tube 315 is adapted to serially or sequentially feed the paintballs 310 to the paintball gun 10. In particular, the uploader system 300 can utilize the removable air bleed system 70, as discussed herein, to provide pressurized air to a loading mechanism 320 of the uploader system 300 to facilitate movement of the paintballs 310 up the discharge tube 315. The discharge tube 315 is coupled to the ball inlet 45 of the paintball gun 10.

By forcing the paintballs 310 to travel upward against the force of gravity, a player can mount the paintball hopper 305 below or beside the paintball gun 10. This is desirable as many hits during a paintball game are scored when hitting a hopper that is mounted above the paintball gun. Unlike conventional uploading systems, the uploader system 300 of the present invention utilizes "free" energy to accomplish its objective. The free energy is excess pressurized air that is available through the use of the removable air bleed system 70. No batteries and/or electronics are necessary. The uploader system 300 also utilizes spring pressure, as will be explained below, to gently motivate the paintballs 310 against the force of gravity. The spring pressure is gentle enough so that the paintballs 310 will not rupture.

Figure 7:
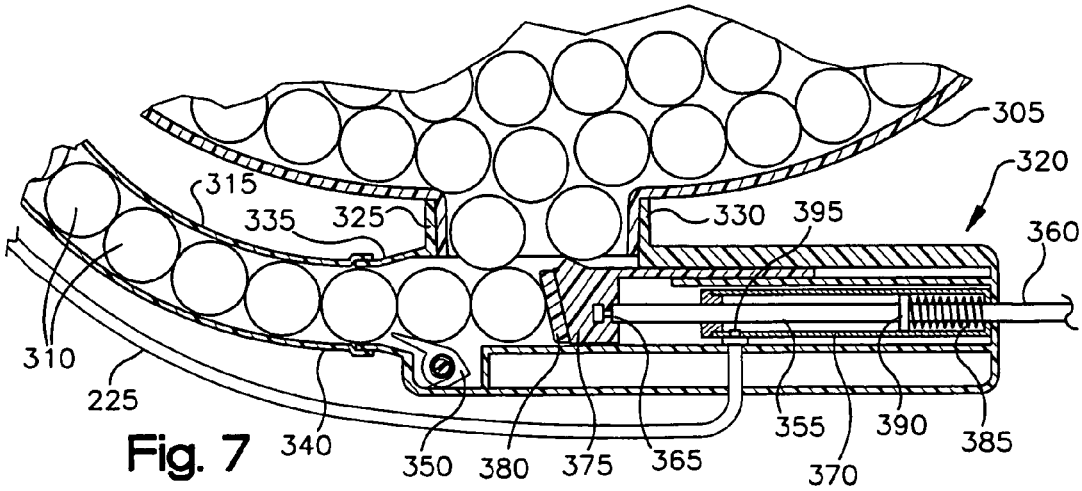
FIG. 7 illustrates a loading mechanism of the uploader system of FIG. 6 in a first position in accordance with an aspect of the present invention.
Figure 8:
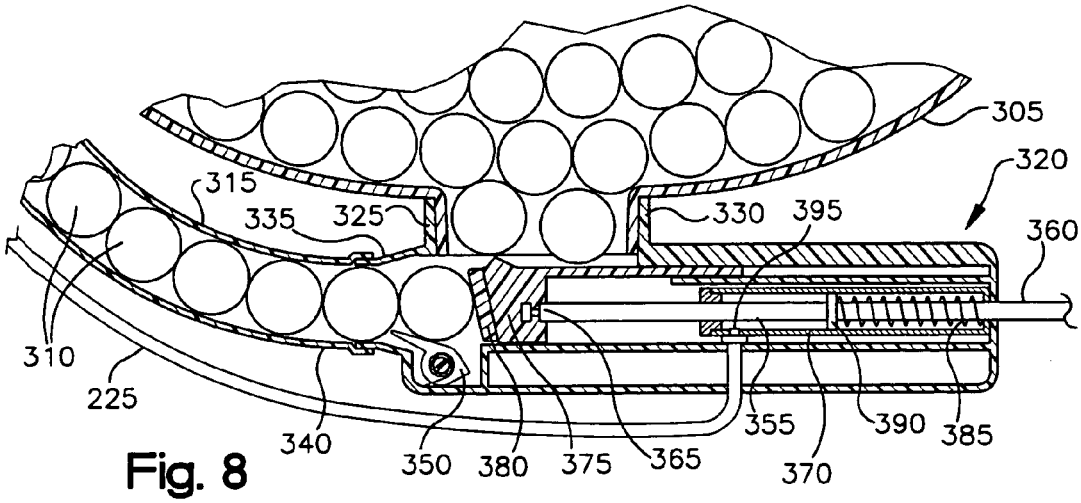
FIG. 8 illustrates a loading mechanism of the uploader system of FIG. 6 in a second position in accordance with an aspect of the present invention.
Figure 9:
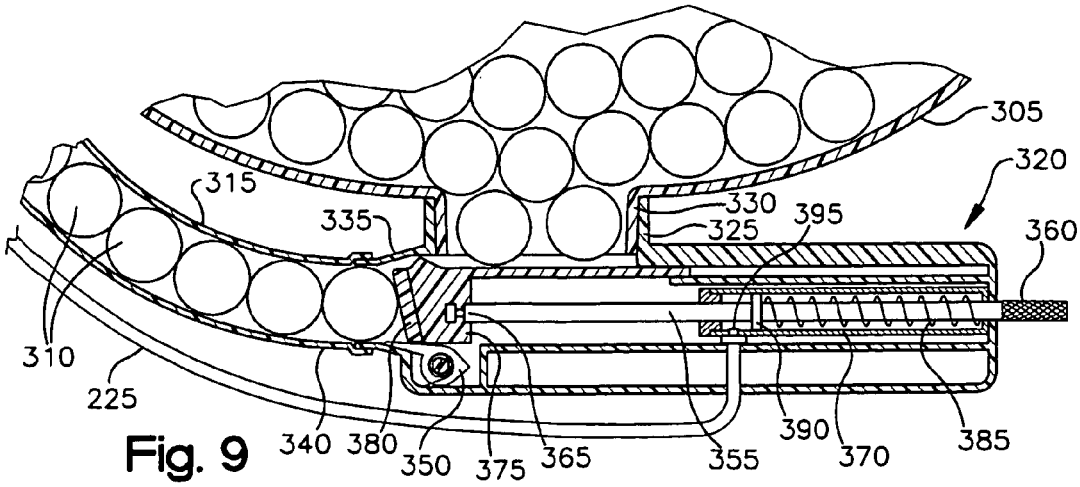
FIG. 9 illustrates a loading mechanism of the uploader system of FIG. 6 in a third position in accordance with an aspect of the present invention.

FIGS. 7-9 illustrate the loading mechanism 320 of the uploader system 300 in greater detail in accordance with an aspect of the present invention. The loading mechanism 320 is coupled to an opening of the paintball hopper 305. In particular, the loading mechanism 320 includes a ball inlet 325 projecting from a top portion thereof for receiving paintballs 310 from the hopper 305 into the loading mechanism 320. The ball inlet 325 can be a substantially cylindrical boss having an inner diameter that substantially corresponds with an outer diameter of a ball outlet 330 provided at a bottom portion of the paintball hopper 305 such that the ball outlet 330 of the paintball hopper 305 can be securely fit into the ball inlet 325 of the loading mechanism 320. The loading mechanism 320 can also include a ball outlet 335 at a side portion thereof for discharging the paintballs 310 from the loading mechanism 320. The ball outlet 335 can also be a substantially cylindrical boss adapted to securely couple to a first end portion 340 of the discharge tube 315. Alternatively, the discharge tube 315 can be integral with the loading mechanism 320.

The loading mechanism 320 further includes a spring biased member 345 and a pivotable finger 350. The spring biased member 345 includes a piston 355 having a first end 360 and a second end 365. The first end of the piston 360 extends outside a piston housing 370 and forms a manual cocking handle, the operation of which will be described below. The second end 365 of the piston 355 is coupled to a loader head 375, which can have an elastomer member 380 coupled to a front portion thereof. The loader head 375 and corresponding elastomer member 380 can have a downwardly angled face so as to facilitate positioning of the paintballs 310 in downwards direction and to mitigate the paintballs 310 from moving upwards into the paintball hopper 305. The spring biased member 345 further includes a spring 385 coupled between a collar portion 390 provided on the piston 355 and an end portion of the piston housing 370.

Turning back to FIG. 6, an example of a "fully loaded" condition of the uploader system 300 is depicted. In the fully loaded condition, the spring biased member 345 is positioned such that the spring 385 is compressed and two paintballs 310 are positioned between the loader head 375 and a pivotable finger 350. Each time the paintball gun 10 is fired, the uploader system 300 can move one to two paintballs 310 in position in the loading mechanism 300. In a typical firing sequence, only one paintball 310 is moved in place. However, in the event or a misfire or if firing of the paintball gun 10 is such that the movement of the paintballs into the firing chamber cannot keep up with the firing, the loading mechanism 300 can load two paintballs 310 into place.

The manual cocking mechanism 360 is utilized for initial loading of the paintballs 310 from the hopper 305 into the discharge tube 315. When loading manually, two paintballs 310 at a time are moved into position in the loading mechanism 300 and subsequently, up the discharge tube 315. The spring 385 provided within the piston housing 370 operates to bias the piston 355 in an extended position, as depicted in FIG. 9. A removable air bleed assembly is coupled to the piston housing 370 via a coupling element 395. The removable air bleed assembly can be similar to the removable air bleed assembly 70 discussed with respect to FIGS. 1-5 herein. Accordingly, in FIGS. 6-9, component parts alike those shown in FIGS. 1-5 are shown by like reference numerals and, the details thereof are not reinstated for the sake of brevity. The coupling element 395 includes a channel (not shown) therein to allow pressurized air bled from the paintball gun 10 into the piston housing 370.

During operation of the paintball gun 10, pressurized air enters the paintball gun 10 to fire a paintball 210 and blow back the hammer 140, as described herein. Additionally, a portion of the pressurized air that enters the second section 95 of the second elongated chamber 30, or the blow back chamber, is bled to the uploader 300 via the power take off pin 185, which is removably positioned in the air bleed aperture 190. The pressurized air enters the pin channels 205, 210 and flows through the pin 185, through the connector 220, and through the tubing 225 to the uploader 300; and specifically, to the piston housing 370. When the pressurized air enters the piston housing 370, the piston 355 is forced backwards against the force of the spring 385 thereby allowing one or more paintballs 310 in the hopper 305 to move into the loading mechanism 320. The downwardly angled wedge shape of the loader head 375 facilitates movement of the paintballs 310 towards the discharge tube 315. The pivotable finger 350 mitigates paintballs 310 positioned within the discharge tube 315 from falling backwards into the loading mechanism 320.

Turning now to FIG. 7, as one paintball 310 is fired from the paintball gun 10, another paintball 310 is released from the discharge tube 315 into the firing chamber of the paintball gun 10. The loader head 375 is spring biased to push the paintballs 310 positioned in the loading mechanism 320 past the pivotable finger 350 into the discharge tube 315. The loader head 375 is angled downwardly to mitigate the paintballs 310 from moving upwards into the hopper 305. In the event of a misfire and instead of one paintball 310, two paintballs 310 are released from the paintball gun 10, the spring biased piston 355 moves the loader head 375 such that two paintballs 310 are moved from the loading mechanism 320 into the discharge tube 315, as illustrated in FIG. 8.

As in the agitator assembly, each time pressurized air is bled from second chamber 30 of the paintball gun 10, to the piston chamber 370 of the uploader 300, the loading mechanism 320 of the uploader 300 is actuated. In other words, each time the trigger 175 of the paintball gun 10 is pulled and the power take off pin 185 is positioned in the air bleed aperture 190, the pressurized air moves the piston 355 and loader head assembly 375 backwards against the bias of the spring 385, which in turn, allows the paintballs 310 to move into the loading mechanism 320 from the hopper 305.

Figure 10:
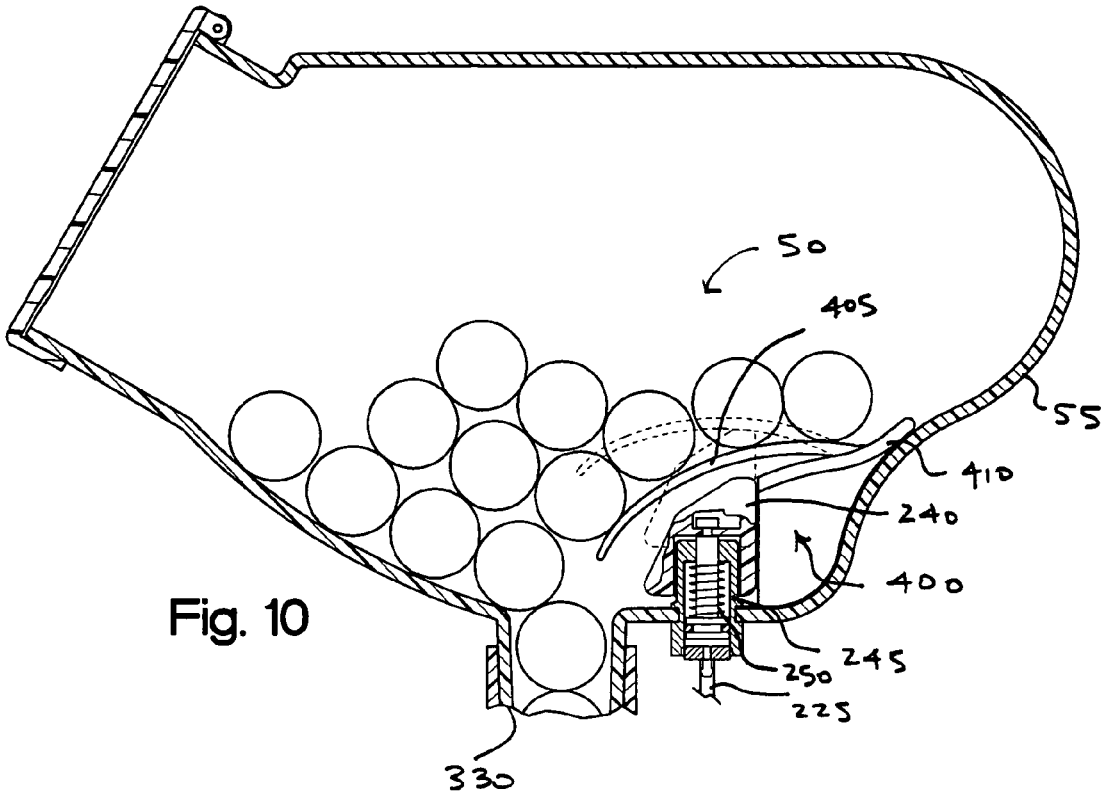
FIG. 10 is a cross-sectional side view of a modified agitator system including a flexible arm in accordance with another aspect of the present invention.
Figure 11:
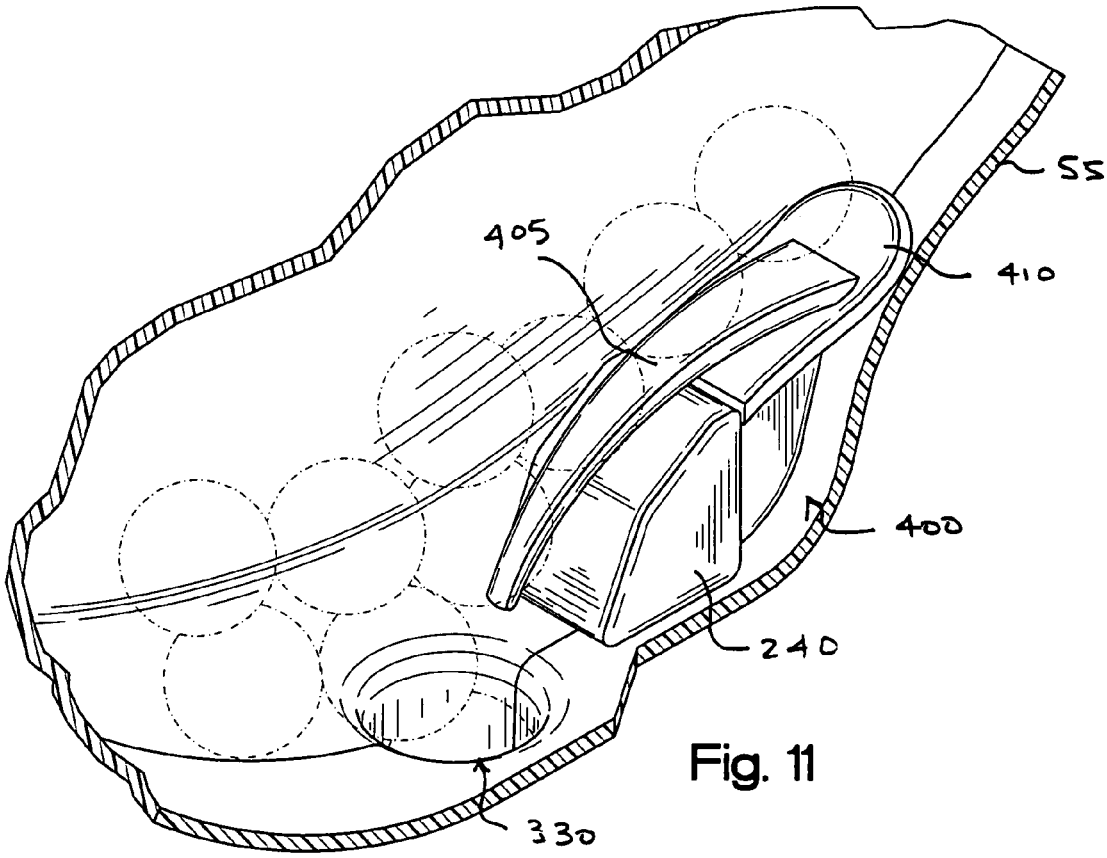
FIG. 11 is a fragmentary perspective view, on an enlarged scale, showing the flexible arm of the agitator system of FIG. 10, with parts broken away for purposes of illustration.

Turning now to FIGS. 10 and 11, another example of an agitator assembly 400 for a paintball gun is illustrated in accordance with an aspect of the present invention. The agitator assembly 400 can include similar components to the agitator assembly 65 described with respect to FIGS. 1-5. Accordingly, like elements are referred to by like reference numerals and will not be further described herein for the sake of brevity. The agitator assembly 400 includes a flexible arm 405 coupled to a top portion thereof. The flexible arm 405 can be manufactured from a polymer material or any other suitable material and is configured as an elongated flexible member that slopes generally downwardly toward the hopper discharge opening 330. The slope of the arm 405 facilitates movement of the paintballs 50 into the first elongated chamber 25 of the paintball gun 10. The arm 405 is coupled to the hopper 55 via a transition member 410, which creates a smooth transition between an inner wall of the hopper and the agitator assembly 400, thereby mitigating breakage of the paintballs 50. It is to be appreciated that the arm 405 itself can be coupled directly to the hopper or a portion of the agitator assembly 400 and can function as a transition member.

During operation of the agitator assembly 400, pressurized air enters the tubing 225 to the agitator assembly 65 via the method described herein. When the pressurized air enters the piston housing 250, the piston 245 is forced upwards against the force of the spring 255 thereby moving the agitator head 240. The agitator head 240 acts against a bottom portion of the arm to flex or bend the arm 405 upward into the paintball hopper 55, thereby agitating or stirring the paintballs 50 in the hopper to mitigate a jam as the paintballs 50 move toward a discharge from the hopper 55 for supply to the paintball gun 10. The elongated shape and gentle slope of the arm 405 both facilitates movement of the paintballs 50 towards the discharge opening of the hopper 55 and mitigates breakage of the paintballs 50 within the hopper. Each time the pressurized air is bled to the agitator assembly 400, the arm 405 is actuated. As discussed herein, the agitator assembly 400 can be actuated each time the trigger 175 of the paintball gun 10 is pulled.

Although the air bleed assembly 70 has been described herein as employing a power take off pin 285 to bleed air from the paintball gun 10, it is to be appreciated that any other removable component, such as a power tube fitting or a t-fitting on the paintball gun, can be employed and is contemplated as falling within the scope of the present invention. Further, it is to be appreciated that the air bleed assembly can be employed with any other suitable auxiliary system and is not limited to an agitator system or an uploader system. Further still, it is to be appreciated that the air bleed assembly can be employed with more than one auxiliary system.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed is:

1. An apparatus comprising:

a paintball gun including a body portion containing pressurized air and having an aperture provided within the body portion of the paintball gun;

a pin;

an elongated pin channel extending through a majority of the pin and being in fluid communication with the body portion;

an air conduit having a first end and a second end, the first end being coupled to and in fluid communication with the elongated pin channel; and an auxiliary system coupled to the second end of the air conduit such that the air conduit delivers pressurized air from the body portion of the paintball gun to the auxiliary system, wherein said pin is manually removable from the aperture provided through the body portion of the paintball gun without the need for any tools.

2. The apparatus of claim 1, wherein the pin includes an axially extending pin body portion having said elongated pin channel extending therein and one or more radial pin channels extending through a body portion of the pin, the one or more radial pin channels being in fluid communication with the elongated pin channel.

3. The apparatus of claim 1, wherein the aperture opens into the body portion from a stationary exterior surface portion of the paintball gun, the pin includes a head portion extending above the exterior surface portion of the paintball gun when the pin is mounted in the aperture and the head portion of the pin includes a shoulder adapted to abut the exterior surface portion of the paintball gun.

4. The apparatus of claim 3, further comprising a connector adapted to couple the head portion of the pin with the first end of the air conduit to provide fluid communication between the tube and the body portion via the elongated pin channel.

5. The apparatus of claim 4, wherein the connector is an elbow connector.

6. The apparatus of claim 1, wherein the air conduit comprises tubing.

7. The apparatus of claim 1, further comprising a connector element coupled to the second end of the air conduit, the connector element including an aperture in fluid communication with the air conduit.

8. A paintball gun and air bleed assembly comprising:

a paintball gun body having an aperture therein;

a pin adapted to be removably positioned within the aperture;

an air conduit having a first end coupled to the pin; and an auxiliary assembly coupled to a second end of the air conduit, wherein the pin includes at least one channel in fluid communication with an elongated chamber of the paintball gun when the pin is positioned within the aperture, and wherein pressurized air can flow from the elongated chamber of the paintball gun to the auxiliary assembly via the air conduit when the pin is positioned within the aperture.

9. The paintball gun and air bleed assembly of claim 8, wherein the aperture is provided through a stationary portion of the paintball gun body that corresponds to a blow back chamber, such that the pin, when positioned within the aperture, is adapted to bleed pressurized air from the blow back chamber.

10. The paintball gun and air bleed assembly of claim 8, wherein the pin includes a head portion extending above the stationary portion of the paintball gun when the pin is removably positioned within the aperture and the first end of the air conduit is coupled to the head portion.

11. The paintball gun and air bleed assembly of claim 1, wherein the auxiliary assembly is an uploader.

12. The paintball gun and air bleed assembly of claim 10, wherein the auxiliary assembly is an agitator.

13. The paintball gun and air bleed assembly of claim 8, wherein the paintball gun comprises:

a first elongated chamber having a cocking shaft and a firing bolt positioned therein;

a second elongated chamber having a hammer and a valve body positioned therein, wherein the hammer is coupled to the cocking shaft.

14. The paintball gun and air bleed assembly of claim 13, wherein the pin, when positioned within the aperture, is adapted to mitigate the valve body from moving backwards towards the hammer within the second elongated chamber.

15. The paintball gun and air bleed assembly of claim 12, wherein the auxiliary assembly includes:

an agitator head coupled to a piston; and a piston housing for slidably housing the piston, wherein the air conduit has a second end coupled to the piston housing such that the air conduit is in fluid communication with an interior portion of the piston housing.

16. The paintball gun and air bleed assembly of claim 15, further comprising a spring provided within the piston housing to bias the piston in a non-extended position.

17. The paintball gun and air bleed assembly of claim 15, further comprising a coupling element adapted to join the air conduit with the piston housing, the coupling element having a channel therein.

18. The paintball gun and air bleed assembly of claim 15, wherein the agitator head is wedge shaped.

19. The paintball gun and air bleed assembly of claim 15, wherein the piston housing is adapted to be secured to a paintball hopper.

20. The paintball gun and air bleed assembly of claim 15, further comprising flexible arm coupled to a top portion of the agitator head.

21. The paintball gun and air bleed assembly of claim 20, wherein the flexible arm in sloped downwardly.

22. The paintball gun and air bleed assembly of claim 11, wherein the auxiliary assembly includes:

a discharge tube; and a loading mechanism adapted to feed paintballs upwards into the discharge tube, wherein the air conduit has a second end coupled to the loading mechanism such that the air conduit is in fluid communication with the loading mechanism.

23. The paintball gun and air bleed assembly of claim 22, wherein the loading mechanism comprises a piston slidably coupled to a piston housing.

24. The paintball gun and air bleed assembly of claim 23, further comprising a loader head coupled to an end portion of the piston.

25. The paintball gun and air bleed assembly of claim 24, wherein the loader head is angled downwardly to mitigate paintballs from moving upwards into a paintball hopper.

26. The paintball gun and air bleed assembly of claim 23, further comprising a manual cocking handle coupled to an end portion of the piston.

27. The paintball gun and air bleed assembly of claim 23, wherein the air conduit is in fluid communication with an interior of the piston housing.

28. The paintball gun and air bleed assembly of claim 23, further comprising a spring to bias the piston in an extended position.

29. The paintball gun and air bleed assembly of claim 22, wherein the loading mechanism includes a pivotable finger biased in a manner to mitigate paintballs from moving downwards from the discharge tube into the loading mechanism.

* * * * *